United States Patent [19]

Ciccotelli

[11] Patent Number: 4,869,696

[45] Date of Patent: Sep. 26, 1989

[54] SWIM FIN

[76] Inventor: Stephen S. Ciccotelli, P.O. Box 1414, Deming, N. Mex. 88031

[21] Appl. No.: 284,606

[22] Filed: Dec. 15, 1988

[51] Int. Cl.[4] ..... A63C 9/309

[52] U.S. Cl. ..... 441/61; 441/55

[58] Field of Search ..... 441/60–64; D21/239, 236; 416/69, 74

[56] References Cited

U.S. PATENT DOCUMENTS

| | | | |
|---|---|---|---|
| 1,607,857 | 11/1926 | Zukal | 441/64 |
| 1,878,916 | 9/1932 | Trujillo | 441/63 |
| 3,171,142 | 3/1965 | Auzols | 441/63 |
| 3,665,535 | 5/1972 | Picken | 441/64 |
| 4,209,866 | 7/1980 | Loeffler | 441/64 |

*Primary Examiner*—Joseph F. Peters, Jr.
*Assistant Examiner*—Edwin L. Swinehart
*Attorney, Agent, or Firm*—William J. Ruano

[57] ABSTRACT

A swim fin having a rigid blade that has the center portion of its leading edge pivotally attached to two beams which project forwardly from the foot pocket. The rigid blade pivots freely for part of its angular movement. The swim fin is designed not to snag seaweed.

8 Claims, 1 Drawing Sheet

SWIM FIN

This invention relates to improvements in a swim fin and comprising an improvement over Patent No. 4,767,368.

BACKGROUND OF THE INVENTION

This swim fin relates to the type of swim fin in which a rigid blade is spaced from the foot pocket and the center portion of the leading edge of the rigid blade is pivotally attached to two beams which are resilient to some extent and which project from the foot pocket.

In the swim fin of prior patent 4,767,368, the resisting force required to support the rigid blade in an angular direction at the operating blade angle during swimming is provided by an extension spring which is designed for a swim fin operating at cruising speed.

One of the problems with such swim fin is that when the swimmer accelerates or when the swimmer starts out from a stationary position, the swimmer has to kick harder causing over stressing of the extension springs, excessive deflection of the blade and some loss of thrust.

Other problems with the extension springs are: they generate drag and they are expensive to use in a swim fin.

SUMMARY OF THE INVENTION

It is an object of this swim fin to provide a swim fin of the type having a wide rigid blade spaced from the foot pocket and having the center portion of the leading edge of the rigid blade pivotally attached to two beams which project from the foot pocket, wherein low cost, low drag profile, non-elastic components support the blade in the angular direction at the operating blade angle during swimming.

Other problems with the swim fin of prior patent 4,767,368 are:

(a) It is difficult to use the swim fin while swimming the conventional style swimming stroke because the blades tend to strike each other during swimming.

(b) Both the blade and the frame snag seaweed, It is an object of this invention to provide a swim fin that does not snag seaweed and which can be used for swimming the flutter kick swimming stroke.

It is another object of this invention to provide a rigid blade for the swim fin that:

(a) is light in weight and low in cost to manufacture, (b) delivers high thrust, (c) can be reversed quickly at the end of each swimming stroke, (d) is stable, (e) requires no stabilizer surface, and does not snag seaweed.

A further object of this invention is to reduce the amount of energy that is required to reverse the rigid blade at the end of each swimming stroke, by permitting the rigid blade to pivot freely for part of its angular movement. To achieve this, it is necessary that no resilient force act on the rigid blade during the time the rigid blade is pivoting freely.

A further object of the present invention is to provide a swim fin which will increase the swimmer's speed and range.

Further objects and advantages of my invention will appear as the specification proceeds.

DESCRIPTION OF THE PREFERRED EMBODIMENTS

Figure 1:
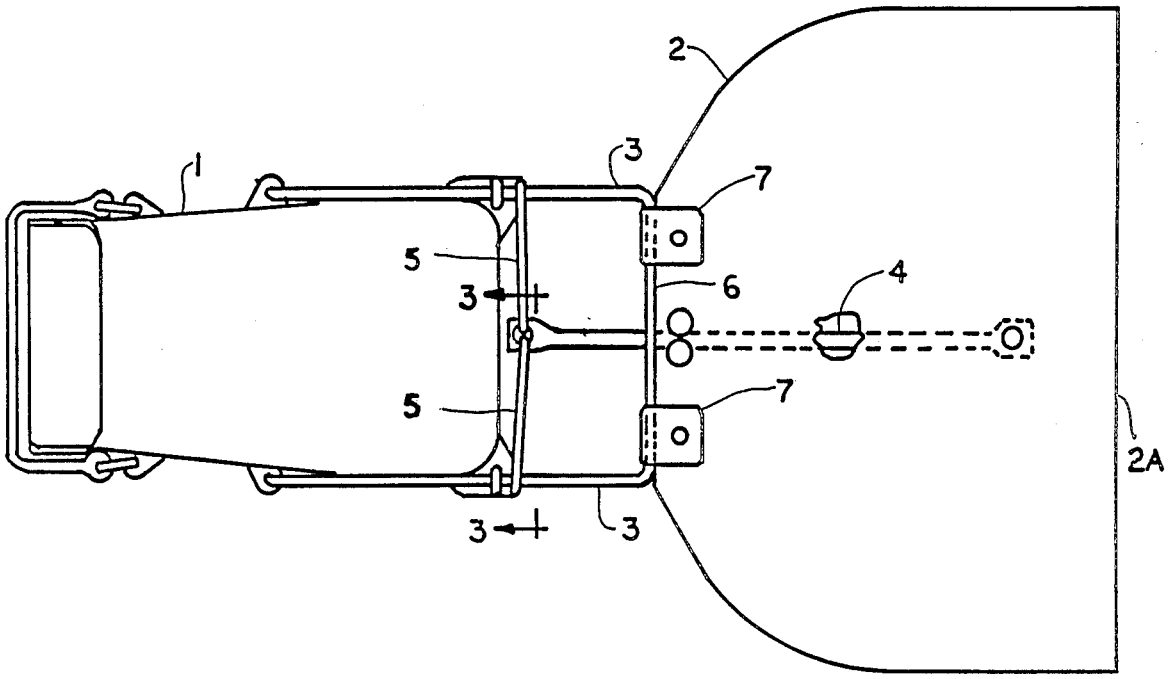
FIG. 1 is a top view of the swim fin which includes a strut 4.
Figure 2:
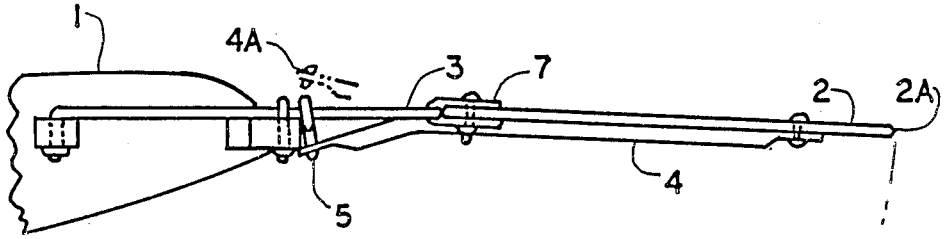
FIG. 2 is a partial side view of FIG. 1.
Figure 3:
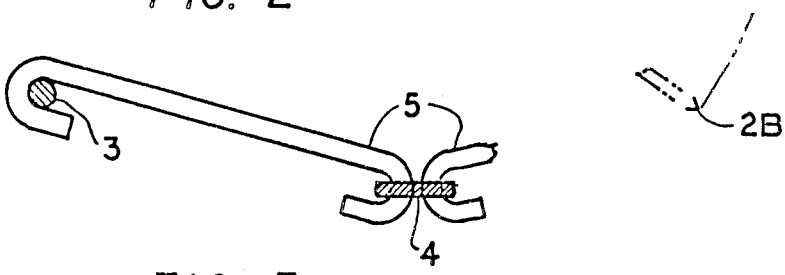
FIG. 3 is an enlarged partial sectional view taken at line 3—3 of FIG. 1 showing the links 5.

Referring to FIGS. 1, 2 and 3 of the drawing, a foot pocket 1 has two beams 3 projecting forwardly therefrom. A cross-member 6 is attached to the ends of the two beams 3 and serves as a hinge pin, the two beams 3 and the cross-member 6 preferably being constructed as a one piece wire form.

A rigid blade 2 is pivotally attached to the cross-member 6 by means of two hinge elements 7 which are fixedly attached to the rigid blade 2.

A strut 4 is fixedly attached to the rigid blade 2 and projects to a position near the toe of the foot pocket 1.

In order to reduce the amount of energy expended by the swimmer in reversing the rigid blade at the end of each swimming stroke, no resilient force acts on the rigid blade 2 for part of the angular movement of the rigid blade 2.

The arcuate movement of the end of the strut 4 is limited by two links 5 having one end of each link connected to the end of the strut 4 and the other end of each link 5 connected to its corresponding beam 3. FIG. 3 shows the links 5 in detail.

Referring to FIG. 2, the rigid blade 2 can pivot freely from the position shown to the position where trailing edge 2A pivots down to position 2B. As the trailing edge 2A of the rigid blade 2 pivots to the position 2B, the end of the strut 4 pivots to the position 4A where farther movement of the end of the strut 4 is limited by the links 5.

For a swim fin designed to be used by a diver swimming with scuba against cross-currents, less freely pivoting of the rigid blade 2 and stiffer beams 3 may be required than shown in FIG. 2.

Because the beams 3 and the strut 4 have some resiliency and because the beams 3 are attached to a foot pocket 1 composed of rubber or thermoplastic elastomer, the combined flexing of the foot pocket 1 and the deflection of the beams 3 and the strut 4 position the operating blade angle with respect to the swimmer's leg at an angular position greater than shown in FIG. 2.

This resiliency in the swim in is an important feature because it cushions the rigid blade 2 from being abruptly stopped by the non-elastic links 5 during blade angle reversal.

In the swim fin of the present invention, part of the strut 4 that projects from the rigid blade 2 is angled downwardly thereby positioning the point of attachment of the links 5 to the strut 4 below the rigid blade 2. This results in the freely pivoting part of the angular movement of the rigid blade 2 occurring, all or mostly all, depending upon the degree to which the strut 4 is angled, on the side below the beams 3. The purpose of this is to compensate for the fact that the arcuate movement of the end of the strut 4 is stopped by the links 5 equi-distantly above and below the beams 3, but since the foot pocket 1 is worn over the swimmer's foot which is angled relative to the leg, little or no angular movement is required above the beams 3.

The swim fin operates much more smoothly when the rigid blade 2 pivots freely for only part of its angular movement since no thrust is developed and the swimmer loses some stability during the time that the rigid blade 2 pivots freely.

In the particular swim fin of the present invention illustrated, the rigid blade 2 is 11.50 inches width and the distance between the leading edge and the trailing edge is 8.00 inches. In the swim fin of prior patent 4,773,885, the width of the blade is also 11.50. It is my experience that 11.50 is about the limit for the width of a rigid blade in a swim fin. Some swimmers naturally swim with their feet sufficiently apart so that the 11.50 blades do not strike each other during swimming, while others have to increase the distance between their feet a little.

Because the distance between the leading edge and the trailing edge of the rigid blade in the swim fin of prior patent 4,773,885 is only 6.50 inches, the blade is unstable during swimming and requires a stabilizer.

By making the distance between the leading edge and the trailing edge 8.00 in the rigid blade 2 of the present invention, the rigid blade 2 becomes stable and requires no stabilizer.

However, increasing the distance between the leading edge and the trailing edge of the rigid blade reduces blade efficiency and also increases the time required to reverse the blade at the end of each swimming stroke.

In the rigid blade of my swim fin; these disadvantages are outweighed by the fact that since there is no resilient force acting on the rigid blade 2 during the time that the rigid blade 2 is pivoting freely, the rigid blade 2 reverses quickly at the end of each swimming stroke and by the fact that the longer blade develops more thrust.

A disadvantage in using a wide rigid blade in a swim fin is that it snags seaweed. To eliminate this problem in the present invention, the leading edge of the rigid blade 2 has a straight portion in the center of the blade about equal in length to the distance across the beams 3 to which the cross-member 6 is pivotally attached, and the remainder of the leading edge is swept back to the lateral sides to deflect seaweed.

To prevent seaweed from becoming entangled in the space between the toe of the foot pocket 1 and the cross-member 6, the length of the beams 3 are made substantially less than the distance between the beams 3.

Figure 4:
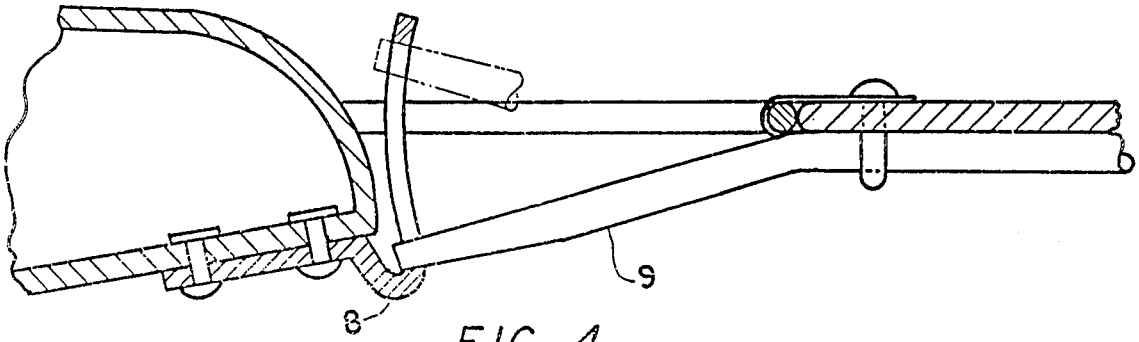
FIG. 4 is a partial sectional view of the swim fin illustrating an alternate method of limiting the arcuate movement of the strut 9.

In FIG. 4, an alternate method of limiting the arcuate movement of the end of the strut 9 is provided by a bracket 8 attached to the sole of the foot pocket. The bracket 8 has an elongated opening wide enough to accept the end of the strut 9 and the ends of the opening serve as stops.

While I have illustrated and described several embodiments of my invention, it will be understood that these are by way of illustration only and that various changes and modifications are contemplated in my invention within the scope of the following claims:

I claim:

1. A swim fin comprising in combination:

(a) a foot pocket; (b) support means comprising two beams, which are resilient to some extent, the beams being attached to the foot pocket and projecting forwardly therefrom and a cross-member attached to the ends of the beams, the distance from a toe end of foot pocket to the cross-member being substantially less than the width of the foot pocket; (c) a rigid blade having a leading edge, a trailing edge, and two lateral sides, the leading edge of the rigid blade having a straight portion at the center of the rigid blade generally equal to the length of the cross-member of the support means and the remainder of the leading edge being swept back to the lateral sides, the distance between the lateral sides being greater than the distance between the straight portion of the leading edge and the trailing edge, the distance between the lateral sides being such that the swim fin can be used comfortably in swimming the conventional swimming stroke, the distance between the straight portion of the leading edge and the trailing edge being such that the rigid blade is stable without a stabilizer surface; (d) a hinge element fixedly attached to the straight portion of the leading edge of the rigid blade and pivotally attached to the cross-member; and (e) means for supporting the rigid blade in the angular direction at the operating blade angle during swimming comprising a strut attached to the rigid blade and projecting to a position near the tow of the foot pocket and non-elastic means which limits the arcuate movement of the end of the strut relative to the foot pocket.

2. In the swim fin of claim 1, wherein; the non-elastic means for limiting the arcuate movement of the end of the strut relative to the foot pocket comprises a non-elastic tension member having one end connected to the strut and another end connected in fixed relationship to the foot pocket.

3. In the swim fin of claim 1, wherein; the two beams and the cross-member of the support means are constructed as a U-shaped wire form and the non-elastic means for limiting the arcuate movement of the end of the strut comprises two links each having one end connected to the end of the strut and each having the other end connected to its corresponding beam of the wire-form.

4. In the swim fin of claim 1, wherein; part of the strut that projects from the rigid blade is angled downwardly relative to the rigid blade so that the end of the strut is positioned below the rigid blade.

5. A swim fin comprising in combination:

(a) a foot pocket; (b) a rigid blade spaced form the foot pocket, the rigid blade having a leading edge, a trailing edge and two lateral sides, the leading edge having a straight portion at the center of the rigid blade and the remainder of the leading edge being swept back to the lateral sides; (c) support means which includes a cross-member, the support means being fixedly attached to the foot pocket and projecting forwardly therefrom to the straight portion of the leading edge of the rigid blade; (d) a hinge element fixedly attached to the straight portion of the rigid blade and pivotally attached to the cross-member of the support means, the cross-member serving as a hinge pin; (e) a strut fixedly attached to the rigid blade and projecting near the toe of the foot pocket; and (f) non-elastic means for limiting the arcuate movement of the end of the strut relative to the foot pocket.

6. In a swim fin of claim 5, wherein; the non-elastic means for limiting the arcuate movement of the end of strut relative to the foot pocket comprises a bracket attached to the toe of the foot pocket, the bracket having an elongated opening wide enough to accept the and of the strut, the ends of the elongated opening serving as stops to limit the arcuate movement of the end of the strut.

7. In a swim fin of claim 5 whereon:

(a) the support means comprises a generally U-shaped wire form having first and second legs and a cross-member, the first and second legs of the U-shaped wire form being fixedly attached to the foot pocket so that the cross-member is spaced from the foot pocket; (b) the means for pivotally attaching the straight portion of the leading edge of the rigid blade to the support means comprises a hinge element fixedly attached to the straight portion of the leading edge of the rigid blade and pivotally attached to the cross-member of the U-shaped wire form, the cross-member serving as a hinge pin; (c) the non elastic means to limit the arcuate movement of the end of the strut relative to the foot pocket comprises two links each having one end connected to its corresponding leg of the U-shaped wire form and each having the other end connected to the end of the strut, the point of attachment of the links to the end of the strut being below the rigid blade.

8. A swim fin comprising in combination:

(a) a foot pocket; (b) a rigid blade spaced from the foot pocket the rigid blade having a leading edge, a trailing edge, and two lateral sides, the leading edge having a straight portion at the center of the rigid blade and the remainder of the leading edge being swept back to the lateral sides; (c) support means comprising a generally U-shaped wire form having first and second legs and a cross-member, the first and second legs of the U-shaped wire form being fixedly attached to the foot pocket; (d) means for pivotally attaching the straight portion of the leading edge of the rigid blade to the cross-member comprising a hinge element fixedly attached to the straight portion of the leading edge of the rigid blade and pivotally attached to the cross-member of the U-shaped wire form, the cross-member serving as a hinge pin; (e) a strut fixedly attached to the rigid blade and projecting to a position near to the toe of the foot pocket; and two links having one end of each link connected to the end of the strut and the other end of each link connected to its corresponding leg of the U-shaped wire form.

* * * * *